US008888561B2

(12) United States Patent
McArdle et al.

(10) Patent No.: US 8,888,561 B2
(45) Date of Patent: Nov. 18, 2014

(54) NONWOVEN ABRASIVE WHEEL

(75) Inventors: James L. McArdle, Wilson, WI (US); Alice B. Moris, Dresser, WI (US); Ann M. Hawkins, Lake Elmo, MN (US); Carl P. Erickson, Deer Park, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 201 days.

(21) Appl. No.: 13/805,622

(22) PCT Filed: Jun. 27, 2011

(86) PCT No.: PCT/US2011/042015

§ 371 (c)(1), (2), (4) Date: Feb. 22, 2013

(87) PCT Pub. No.: WO2012/006017

PCT Pub. Date: Jan. 12, 2012

(65) Prior Publication Data

US 2013/0157544 A1 Jun. 20, 2013

Related U.S. Application Data

(60) Provisional application No. 61/359,001, filed on Jun. 28, 2010.

(51) Int. Cl.

| | |
|---|---|
| ***B24D 11/00*** | (2006.01) |
| ***B24B 29/02*** | (2006.01) |
| ***B24D 3/00*** | (2006.01) |
| ***B24D 3/32*** | (2006.01) |
| ***B24D 13/08*** | (2006.01) |
| ***B24D 13/12*** | (2006.01) |
| ***B24D 13/14*** | (2006.01) |
| ***B24B 1/00*** | (2006.01) |

(52) U.S. Cl.

CPC ..... *B24D 11/00* (2013.01); *B24B 29/02* (2013.01); *B24D 3/002* (2013.01); *B24D 3/32* (2013.01); *B24D 13/08* (2013.01); *B24D 13/12* (2013.01); *B24D 13/147* (2013.01); *B24B 1/00* (2013.01)

USPC ..... 451/59; 451/536; 451/541

(58) Field of Classification Search

CPC ..... B24D 11/00; B24D 5/12; B24D 18/00; B24D 5/06; B24D 5/02; B24D 5/16; B24B 21/04; B24B 1/00; B24B 9/00; B24B 37/04; B24B 21/00

USPC ..... 451/536, 541, 59; 51/297–298

See application file for complete search history.

(56) References Cited

U.S. PATENT DOCUMENTS 2,327,900 A * 8/1943 Jarm et al. ..... 51/301
2,958,593 A 11/1960 Hoover (Continued)

FOREIGN PATENT DOCUMENTS

KR 10-2008-0007225 1/2008

*Primary Examiner* — George Nguyen
(74) *Attorney, Agent, or Firm* — Scott A. Baum

(57) ABSTRACT

A nonwoven abrasive wheel comprising one or more layers of a nonwoven fiber web, a plurality of super abrasive particles having a Vickers hardness greater than 40 GPa, a polyurethane binder adhering the plurality of super abrasive particles to the nonwoven fibers and adhering the layers of the nonwoven fiber web to each other, and wherein the nonwoven abrasive wheel comprises a Flexural Modulus from 4.0 to 128.0 lb/inch of thickness per inch of displacement.

7 Claims, 3 Drawing Sheets

(56) References Cited

U.S. PATENT DOCUMENTS

| | | | | | |
|---|---|---|---|---|---|
| 3,529,945 | A | * | 9/1970 | Charvat | 51/295 |
| 4,018,575 | A | * | 4/1977 | Davis et al. | 51/295 |
| 4,078,340 | A | | 3/1978 | Klecker | |
| 4,311,489 | A | | 1/1982 | Kressner | |
| 4,437,271 | A | * | 3/1984 | McAvoy | 451/532 |
| 4,652,275 | A | | 3/1987 | Bloecher | |
| 4,799,939 | A | | 1/1989 | Bloecher | |
| 5,250,085 | A | | 10/1993 | Mevissen | |
| 5,306,319 | A | * | 4/1994 | Krishnan et al. | 51/298 |
| 5,417,726 | A | * | 5/1995 | Stout et al. | 51/293 |
| 5,482,756 | A | * | 1/1996 | Berger et al. | 428/36.2 |
| 5,580,634 | A | * | 12/1996 | Stout et al. | 428/65.9 |
| 5,591,239 | A | | 1/1997 | Larson | |
| 5,849,646 | A | * | 12/1998 | Stout et al. | 442/68 |
| 5,928,070 | A | * | 7/1999 | Lux | 451/526 |
| 6,004,198 | A | * | 12/1999 | Sumiyoshi | 451/535 |
| 6,017,831 | A | * | 1/2000 | Beardsley et al. | 442/68 |
| 6,302,930 | B1 | * | 10/2001 | Lux | 51/298 |
| 6,575,824 | B2 | * | 6/2003 | Kuramochi et al. | 451/527 |
| 6,607,570 | B1 | * | 8/2003 | Rosenflanz et al. | 51/309 |
| 6,706,083 | B1 | * | 3/2004 | Rosenflanz | 51/309 |
| 6,723,142 | B2 | | 4/2004 | Emerson | |
| 6,866,692 | B2 | | 3/2005 | Emerson | |
| 2006/0041065 | A1 | | 2/2006 | Barber, Jr. | |
| 2006/0148393 | A1 | | 7/2006 | Ono | |
| 2008/0127572 | A1 | * | 6/2008 | Ludwig | 51/297 |
| 2008/0206576 | A1 | * | 8/2008 | Qian et al. | 428/446 |
| 2011/0258937 | A1 | * | 10/2011 | Qian et al. | 51/297 |
| 2012/0088443 | A1 | * | 4/2012 | Hsu et al. | 451/540 |
| 2012/0167478 | A1 | * | 7/2012 | Herbert | 51/295 |
| 2012/0220207 | A1 | * | 8/2012 | Dean | 451/490 |

* cited by examiner

NONWOVEN ABRASIVE WHEEL

CROSS REFERENCE TO RELATED APPLICATIONS

This application is a national stage filing under 35 U.S.C. 371 of PCT/US2011/042015 filed Jun. 27, 2011, which claims priority to U.S. Provisional Patent Application No. 61/359,001, filed Jun. 28, 2010, the disclosures of which are incorporated by reference in their entirety herein.

BACKGROUND

Metal fabrication tools, including drill bits, end mills, and similar cutting tools, are frequently fabricated from extremely hard materials such as cemented or metal bonded carbides to remain sharp for extended periods of time in use. Metal fabrication tools often have helically-disposed or straight cutting edges and flutes. In order to promote easier removal of cut metal, the tool flutes can be refined to a mirror or polished finish. These polishing operations can be accomplished with vitrified or metal-bonded abrasive wheels that are dressed and shaped to the desired profile. Vitrified or metal-bonded abrasive wheels accommodate only one profile at any time and must be frequently dressed to renew the desired profile.

Alternatively, very soft compliant wheel materials such as leather or compressed cotton can be charged with diamond pastes and applied to the tool flute surface to effect surface refinement to a polished or specular condition. However, use of slurry or paste abrasives is generally unfavorable due to cost and difficulty of use. Thus, providing polished flutes on metal fabrication tools using either polishing method is unacceptable for the vast majority of metal fabrication tools that are supplied to the market. A simple cost effective solution to effectively polish very hard surfaces is desirable in industry.

SUMMARY

Nonwoven abrasive wheels can conform to various profiles as they polish a workpiece surface. Such nonwoven abrasive wheels are generally constructed from a nonwoven fiber web (e.g., a lofty open fiber web), abrasive particles, and a binder material (commonly termed a "binder") that bonds the fibers to each other and secures the abrasive particles to the nonwoven web. Examples of nonwoven abrasive wheels include convolute abrasive wheels (spirally wound nonwoven abrasive web around a core) and unitized abrasive wheels (one or more individual discs of nonwoven abrasive web formed into a stack). Nonwoven abrasive wheels are available from 3M Company of Saint Paul, Minn. under the trade designation "SCOTCH-BRITE".

The inventors have determined that a nonwoven abrasive wheel having a Flexural Modulus (compliance) within a specific range and having sufficiently hard abrasive particles unexpectedly results in a mirror finish on the flutes of a metal fabrication tool. This result occurs even though the surface roughness of the metal fabrication tool may be greater than the mirror polish produced by a vitrified abrasive wheel. The nonwoven abrasive wheel, instead of flattening out and removing minor surface irregularities such as exposed tungsten carbide phases, is able to polish around and over them providing the same benefits with less stock removal required. This can produce a polished flute in less time and does not require a specific profile on the nonwoven abrasive wheel that is matched to the profile of the flute. Thus, the nonwoven abrasive wheel can be used to polish virtually any metal fabrication tool and does not need to be dressed to change to another flute profile. Additionally, because the nonwoven abrasive wheel is significantly more compliant than a vitrified abrasive wheel, it is significantly less likely to inadvertently damage the cutting edges of the metal fabrication tool resulting in fewer damaged tools during polishing operations.

Thus, the Flexural Modulus (compliance) of the nonwoven abrasive wheel should be sufficiently stiff to enable a mirror polish to be produced, yet sufficiently flexible to prevent damaging or changing the profile of the cutting edges of the metal fabrication tool during use.

Hence in one aspect the invention resides in a nonwoven abrasive wheel comprising one or more layers of a nonwoven fiber web, a plurality of super abrasive particles having a Vickers hardness greater than 40 GPa, a polyurethane binder adhering the plurality of super abrasive particles to the nonwoven fibers and adhering the layers of the nonwoven fiber web to each other, and wherein the nonwoven abrasive wheel comprises a Flexural Modulus from 4.0 to 128.0 lb/inch of thickness per inch of displacement.

BRIEF DESCRIPTION OF THE DRAWINGS

It is to be understood by one of ordinary skill in the art that the present discussion is a description of exemplary embodiments only, and is not intended as limiting the broader aspects of the present disclosure, which broader aspects are embodied in the exemplary construction. The Figures are for illustration only and should not be used for scaling the actual size of the nonwoven abrasive web or the resulting nonwoven abrasive wheel.

DETAILED DESCRIPTION

Figure 1A:
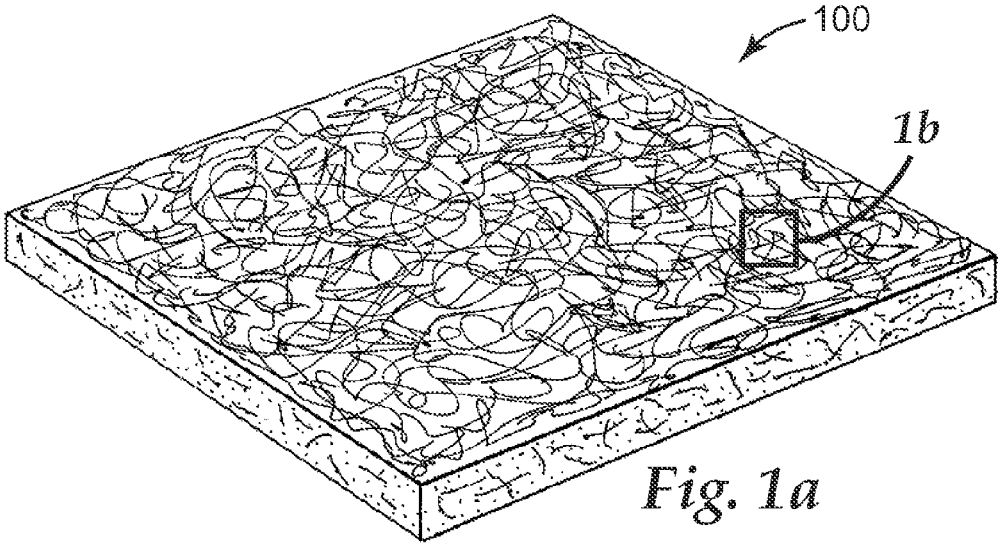
FIG. 1*a* illustrates a perspective view of a nonwoven abrasive web.

Nonwoven abrasive wheels, such as unitized abrasive wheels and convolute abrasive wheels, can be prepared from lofty, fibrous, bonded, nonwoven sheets or webs containing super abrasive particles such as diamond or cubic boron nitrate abrasive particles. Such sheets or webs may be manufactured through processes that include coating a curable composition, typically in slurry form, on or throughout a nonwoven fibrous web. In the formation of unitized or convolute abrasive wheels, the nonwoven fiber web is typically compressed (i.e., densified) relative to nonwoven fiber webs used in lofty open nonwoven articles.

Nonwoven fiber webs suitable for use are known in the abrasives art. Typically, the nonwoven fiber web comprises an entangled web of fibers. The fibers may comprise continuous fiber, staple fiber, or a combination thereof. For example, the fiber web may comprise staple fibers having a length of at least about 20 millimeters (mm), at least about 30 mm, or at least about 40 mm, and less than about 110 mm, less than about 85 mm, or less than about 65 mm, although shorter and longer fibers (e.g., continuous filaments) may also be useful. The fibers may have a fineness or linear density of at least about 1.7 decitex (dtex, i.e., grams/10000 meters), at least about 6 dtex, or at least about 17 dtex, and less than about 560 dtex, less than about 280 dtex, or less than about 120 dtex, although fibers having lesser and/or greater linear densities may also be useful. Mixtures of fibers with differing linear densities may be useful, for example, to provide an abrasive article that upon use will result in a specifically preferred surface finish. If a spunbond nonwoven is used, the filaments may be of substantially larger diameter, for example, up to 2 mm or more in diameter.

The fiber web may be made, for example, by conventional air laid, carded, stitch bonded, spun bonded, wet laid, and/or melt blown procedures. Air laid fiber webs may be prepared using equipment such as, for example, that available under the trade designation "RANDO WEBBER" commercially available from Rando Machine Company of Macedon, N.Y.

Nonwoven fiber webs are typically selected to be compatible with adhering binders and abrasive particles while also being compatible with other components of the article, and typically can withstand processing conditions (e.g., temperatures) such as those employed during application and curing of the curable composition. The fibers may be chosen to affect properties of the abrasive article such as, for example, flexibility, elasticity, durability or longevity, abrasiveness, and finishing properties. Examples of fibers that may be suitable include natural fibers, synthetic fibers, and mixtures of natural and/or synthetic fibers. Examples of synthetic fibers include those made from polyester (e.g., polyethylene terephthalate), nylon (e.g., hexamethylene adipamide, polycaprolactam), polypropylene, acrylonitrile (i.e., acrylic), rayon, cellulose acetate, polyvinylidene chloride-vinyl chloride copolymers, and vinyl chloride-acrylonitrile copolymers. Examples of suitable natural fibers include cotton, wool, jute, and hemp. The fiber may be of virgin material or of recycled or waste material, for example, reclaimed from garment cuttings, carpet manufacturing, fiber manufacturing, or textile processing. The fiber may be homogenous or a composite such as a bicomponent fiber (e.g., a co-spun sheath-core fiber). The fibers may be tensilized and crimped, but may also be continuous filaments such as those formed by an extrusion process. Combinations of fibers may also be used.

Prior to impregnation with the curable composition, the nonwoven fiber web typically has a weight per unit area (i.e., basis weight) of at least about 50 grams per square meter (gsm), at least about 100 gsm, or at least about 200 gsm; and/or less than about 400 gsm, less than about 350 gsm, or less than about 300 gsm, as measured prior to any coating (e.g., with the curable composition or optional pre-bond resin), although greater and lesser basis weights may also be used. In addition, prior to impregnation with the curable composition, the fiber web typically has a thickness of at least about 5 mm, at least about 6 mm, or at least about 10 mm; and/or less than about 200 mm, less than about 75 mm, or less than about 30 mm, although greater and lesser thicknesses may also be useful.

Further details concerning nonwoven abrasive articles, abrasive wheels and methods for their manufacture may be found, for example, in U.S. Pat. No. 2,958,593 (Hoover et al.); U.S. Pat. No. 5,591,239 (Larson et al.); U.S. Pat. No. 6,017,831 (Beardsley et al.); and in U.S. patent application publication 2006/0041065 A 1 (Barber, Jr.).

Frequently, as known in the abrasive art, it is useful to apply a pre-bond resin to the nonwoven fiber web prior to coating with the curable composition. The pre-bond resin serves, for example, to help maintain the nonwoven fiber web integrity during handling, and may also facilitate bonding of the urethane binder to the nonwoven fiber web. Examples of prebond resins include phenolic resins, urethane resins, hide glue, acrylic resins, urea-formaldehyde resins, melamine-formaldehyde resins, epoxy resins, and combinations thereof. The amount of pre-bond resin used in this manner is typically adjusted toward the minimum amount consistent with bonding the fibers together at their points of crossing contact. In those cases where the nonwoven fiber web includes thermally bondable fibers, thermal bonding of the nonwoven fiber web may also be helpful to maintain web integrity during processing.

Useful abrasive particles are super abrasive particles such as diamond, cubic boron nitride, and combinations thereof. The super abrasive particles should have a Vickers hardness greater than 40 GPa. The abrasive particles may be in the form of, for example, individual particles, agglomerates, composite particles, and mixtures thereof. Suitable abrasive particles are available, for example, from Pinnacle Abrasives, Walnut Creek, Calif.

Generally, the average size of agglomerate particles comprising diamond particles larger than 15 micrometers is about 100 to about 1000 micrometers, preferably about 100 to about 400 micrometers and more preferably about 225 to about 350 micrometers. However, the average size of the agglomerate particles which comprise diamond particles less than 15 micrometers is about 20 to about 450 micrometers, preferably about 40 to about 400 micrometers and more preferably about 70 to about 300 micrometers.

Abrasive agglomerates are further described in U.S. Pat. Nos. 4,311,489; 4,652,275; and 4,799,939. The abrasive particle may further comprise a surface treatment or coating, such as a coupling agent or metal or ceramic coatings.

For some applications, it is preferred that the abrasive wheel use diamond abrasive particles or abrasive agglomerates comprising diamonds. These diamond abrasive particles may be natural or synthetically made diamond and may be considered "resin bond diamonds", "saw blade grade diamonds", or "metal bond diamonds". The single diamonds may have a blocky shape associated with them or alternatively, a needle like shape. The single diamond particles may contain a surface coating such as a metal coating (for example, nickel, aluminum, copper or the like), an inorganic coating (for example, silica), or an organic coating.

The abrasive particles may, for example, have an average diameter of at least about 0.1 micrometer, at least about 1 micrometer, or at least about 10 micrometers, and less than about 2000, less than about 1300 micrometers, or less than about 1000 micrometers, although larger and smaller abrasive particles may also be used. For example, the abrasive particles may have an abrasives industry specified nominal grade. Such abrasives industry accepted grading standards include those known as the American National Standards Institute, Inc. (ANSI) standards, Federation of European Producers of Abrasive Products (FEPA) standards, and Japanese Industrial Standard (JIS) standards. Exemplary ANSI grade designations (i.e., specified nominal grades) include: ANSI 100, ANSI 120, ANSI 150, ANSI 180, ANSI 220, ANSI 240, ANSI 280, ANSI 320, ANSI 360, ANSI 400, and ANSI 600. Exemplary FEPA grade designations include P120, P150, P180, P220, P320, P400, P500, 600, P800, P1000, and P1200. Exemplary JIS grade designations include JIS100, JIS150, JIS180, JIS220, JIS 240, JIS280, JIS320, JIS360, JIS400, JIS400, JIS600, JIS800, JIS1000, JIS1500, JIS2500, JIS4000, JIS6000, JIS8000, and JIS10000.

For imparting a reflective or specular surface finish the abrasive particles generally have an average size from 1 to 45 micrometers, or 1 to 30 micrometers, or 1 to 15 micrometers. Exemplary ANSI grade designations (i.e., specified nominal grades) for the desired polishing include: ANSI 320, ANSI 360, ANSI 400, ANSI 500, ANSI 600, ANSI 800, ANSI 1000, and ANSI 1200. Exemplary FEPA grade designations include P400, P500, P600, P800, P1000, P1200, P1500, P2000, and P2500. Exemplary JIS grade designations include JIS400, JIS500, JIS600, JIS700, JIS800, JIS1000, JIS1200, JIS1500, JIS2000, JIS2500, JIS300, JIS4000, JIS6000, JIS8000, and JIS10000. When the abrasive particle size is too small, an insufficient number of surface scratches are removed. When the abrasive particle size is too large, a desirable reflective surface cannot be achieved.

Typically, the coating weight for the abrasive particles (independent of other ingredients in the curable composition) may depend, for example, on the particular binder used, the process for applying the abrasive particles, and the size of the abrasive particles. For example, the coating weight of the abrasive particles on the nonwoven fiber web (before any compression) may be at least 200 grams per square meter ($g/m^2$), at least 600 $g/m^2$, or at least 800 $g/m^2$; and/or less than 2000 $g/m^2$, less than about 1600 $g/m^2$, or less than about 1200 $g/m^2$, although greater or lesser coating weights may be also be used.

In some embodiments, the binder precursor is a urethane prepolymer. Examples of useful urethane prepolymers include polyisocyanates and blocked versions thereof. Typically, blocked polyisocyanates are substantially unreactive to isocyanate reactive compounds (e.g., amines, alcohols, thiols, etc.) under ambient conditions (e.g., temperatures in a range of from about 20° C. to about 25° C.), but upon application of sufficient thermal energy the blocking agent is released, thereby generating isocyanate functionality that reacts with the amine curative to form a covalent bond.

Useful polyisocyanates include, for example, aliphatic polyisocyanates (e.g., hexamethylene diisocyanate or trimethylhexamethylene diisocyanate); alicyclic polyisocyanates (e.g., hydrogenated xylylene diisocyanate or isophorone diisocyanate); aromatic polyisocyanates (e.g., tolylene diisocyanate or 4,4'-diphenylmethane diisocyanate); adducts of any of the foregoing polyisocyanates with a polyhydric alcohol (e.g., a diol, low molecular weight hydroxyl group-containing polyester resin, water, etc.); adducts of the foregoing polyisocyanates (e.g., isocyanurates, biurets); and mixtures thereof.

Useful commercially available polyisocyanates include, for example, those available under the trade designation "ADIPRENE" from Chemtura Corporation, Middlebury, Conn. (e.g., "ADIPRENE L 0311", "ADIPRENE L 100", "ADIPRENE L 167", "ADIPRENE L 213", "ADIPRENE L 315", "ADIPRENE L 680", "ADIPRENE LF 1800A", "ADIPRENE LF 600D", "ADIPRENE LFP 1950A", "ADIPRENE LFP 2950A", "ADIPRENE LFP 590D", "ADIPRENE LW 520", and "ADIPRENE PP 1095"); polyisocyanates available under the trade designation "MONDUR" from Bayer Corporation, Pittsburgh, Pa. (e.g., "MONDUR 1437", "MONDUR MP-095", or "MONDUR 448"); and polyisocyanates available under the trade designations "AIRTHANE" and "VERSATHANE" from Air Products and Chemicals, Allentown, Pa. (e.g., "AIRTHANE APC-504", "AIRTHANE PST-95A", "AIRTHANE PST-85A", "AIRTHANE PET-91A", "AIRTHANE PET-75D", "VERSATHANE STE-95A", "VERSATHANE STE-P95", "VERSATHANE STS-55", "VERSATHANE SME-90A", and "VERSATHANE MS-90A").

To lengthen pot-life, polyisocyanates such as, for example, those mentioned above may be blocked with a blocking agent according to various techniques known in the art. Exemplary blocking agents include ketoximes (e.g., 2-butanone oxime); lactams (e.g., epsilon-caprolactam); malonic esters (e.g., dimethyl malonate and diethyl malonate); pyrazoles (e.g., 3,5-dimethylpyrazole); alcohols including tertiary alcohols (e.g., t-butanol or 2,2-dimethylpentanol), phenols (e.g., alkylated phenols), and mixtures of alcohols as described.

Exemplary useful commercially available blocked polyisocyanates include those marketed by Chemtura Corporation under the trade designations "ADIPRENE BL 11", "ADIPRENE BL 16", "ADIPRENE BL 31", and blocked polyisocyanates marketed by Baxenden Chemicals, Ltd., Accrington, England under the trade designation "TRIXENE" (e.g., "TRIXENE BL 7641", "TRIXENE BL 7642", "TRIXENE BL 7772", and "TRIXENE BL 7774").

Typically, the amount of urethane prepolymer present in the curable composition is in an amount of from 10 to 40 percent by weight, more typically in an amount of from 15 to 30 percent by weight, and even more typically in an amount of from 20 to 25 percent by weight based on the total weight of the curable composition, although amounts outside of these ranges may also be used.

Suitable amine curatives include aromatic, alkyl-aromatic, or alkyl polyfunctional amines, preferably primary amines Examples of useful amine curatives include 4,4'-methylenedianiline; polymeric methylene dianilines having a functionality of 2.1 to 4.0 which include those known under the trade designations "CURITHANE 103", commercially available from the Dow Chemical Company, and "MDA-85" from Bayer Corporation, Pittsburgh, Pa.; 1,5-diamine-2-methylpentane; tris(2-aminoethyl)amine; 3-aminomethyl-3,5,5-trimethylcyclohexylamine (i.e., isophoronediamine), trimethylene glycol di-p-aminobenzoate, bis(o-aminophenylthio) ethane, 4,4'-methylenebis(dimethyl anthranilate), bis(4-amino-3-ethylphenyl)methane (e.g., as marketed under the trade designation "KAYAHARD AA" by Nippon Kayaku Company, Ltd., Tokyo, Japan), and bis(4-amino-3,5-diethylphenyl)methane (e.g., as marketed under the trade designation "LONZACURE M-DEA" by Lonza, Ltd., Basel, Switzerland), and mixtures thereof. If desired, polyol(s) may be added to the curable composition, for example, to modify (e.g., to retard) cure rates as required by the intended use.

The amine curative should be present in an amount effective (i.e., an effective amount) to cure the blocked polyisocyanate to the degree required by the intended application; for example, the amine curative may be present in a stoichiometric ratio of curative to isocyanate (or blocked isocyanate) in a range of from 0.8 to 1.35; for example, in a range of from 0.85 to 1.20, or in a range of from 0.90 to 0.95, although stoichiometric ratios outside these ranges may also be used.

Typically, the curable composition will include at least one organic solvent (e.g., isopropyl alcohol or methyl ethyl ketone) to facilitate coating of the curable composition on the nonwoven fiber web, although this is not a requirement.

Optionally, the curable composition may be mixed with and/or include one or more additives. Exemplary additives include fillers, plasticizers, surfactants, lubricants, colorants (e.g., pigments), bactericides, fungicides, grinding aids, and antistatic agents.

Desirable urethane binders have a cured Shore D durometer hardness from 35 to 80 Shore D, or from 38 to 77 Shore D, or from 41 to 74 Shore D. When the hardness is too low it is more difficult to make the resulting abrasive wheel stiff enough to achieve a reflective surface. When the hardness is too great, the resulting abrasive wheel can become too stiff and no longer produce a reflective surface on carbide materials.

One method of making nonwoven abrasive webs according to the present invention includes the steps in the following order: applying a prebond coating to the nonwoven fiber web (e.g., by roll-coating or spray coating), curing the prebond coating, impregnating the nonwoven fiber web with the curable composition (e.g., by roll-coating or spray coating), and curing the curable composition.

Typically, the curable composition (including any solvent that may be present) is coated onto the nonwoven fiber web in an amount of from 1120 to 2080 gsm, more typically 1280-1920 gsm, and even more typically 1440-1760 gsm, although values outside these ranges may also be used.

Figure 1B:
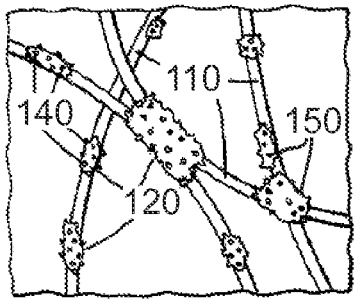
FIG. 1*b* illustrates an enlarged view of the nonwoven abrasive web of FIG. 1*a*.

An exemplary embodiment of a nonwoven abrasive article is shown in FIGS. 1*a* and 1*b*, wherein lofty open low-density fibrous web 100 is formed of entangled filaments 110 held together by polyurethane binder 120. Super abrasive particles 140 are dispersed throughout fibrous web 100 on exposed surfaces of filaments 110. Polyurethane binder 120 coats portions of filaments 110 and forms globules 150 which may encircle individual filaments or bundles of filaments, adhere to the surface of the filament and/or collect at the intersection of contacting filaments, providing abrasive sites throughout the nonwoven abrasive article.

Figure 2:
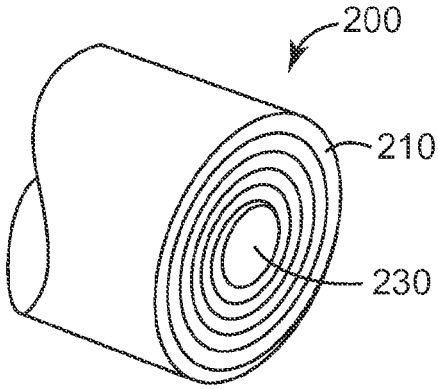
FIG. 2 illustrates a perspective view of a convolute abrasive wheel.

Convolute abrasive wheels may be provided, for example, by winding the nonwoven fiber web that has been impregnated with the curable composition under tension around a core member (e.g., a tubular or rod-shaped core member) such that the impregnated nonwoven fiber layers become compressed, and then curing the curable composition to provide a polyurethane binder binding the abrasive particles to the layered nonwoven fiber web and binding layers of the layered nonwoven fiber web to each other. A convolute abrasive wheel 200 is shown in FIG. 2, wherein layered nonwoven fiber web 210, coated with polyurethane binder binding the abrasive particles to the layered nonwoven fiber web and binding layers of the layered nonwoven fiber web to each other is spirally disposed around and affixed to core member 230. If desired, convolute abrasive wheels may be dressed prior to use to remove surface irregularities, for example, using methods known in the abrasive arts.

Figure 3:
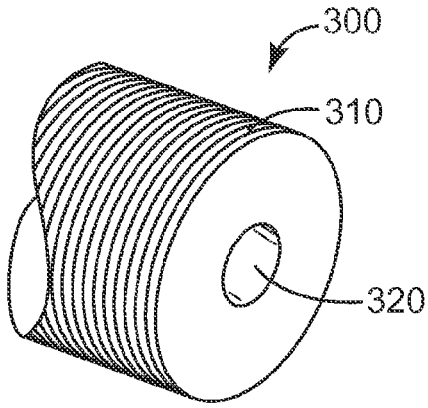
FIG. 3 is a perspective view of a unitized abrasive wheel.
Figure 4:
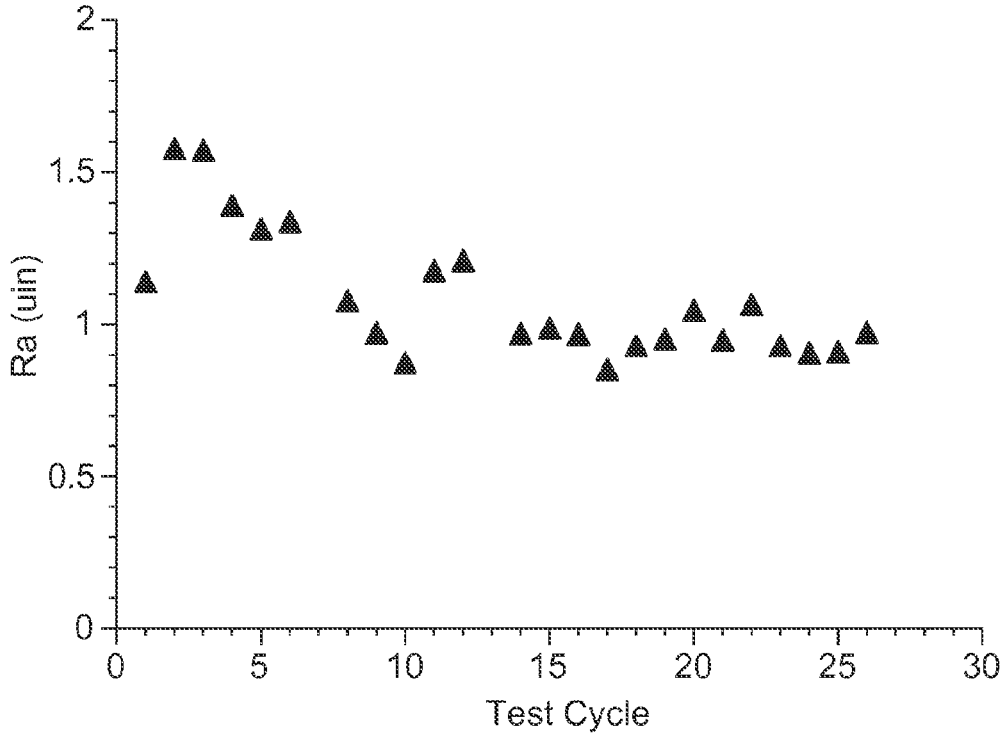
FIG. 4 is a graph of surface finish, Ra, on tungsten carbide using an Example 4 nonwoven abrasive wheel.
Figure 5:
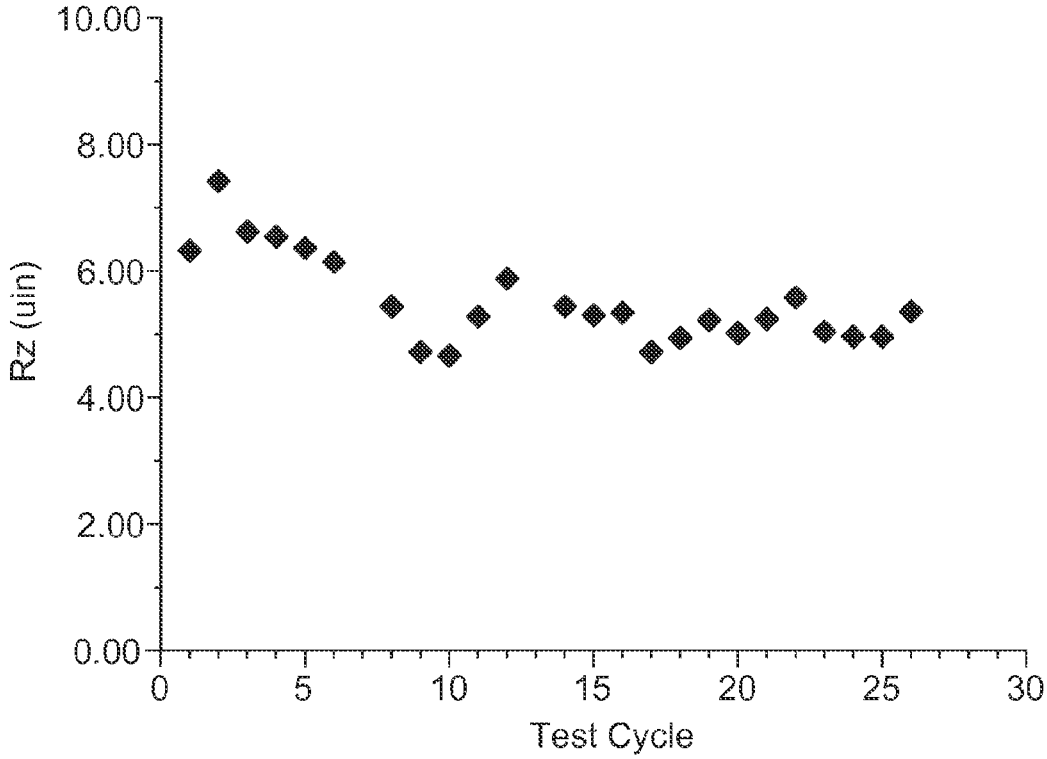
FIG. 5 is a graph of surface finish, Rz, on tungsten carbide using an Example 4 nonwoven abrasive wheel.
Figure 6:
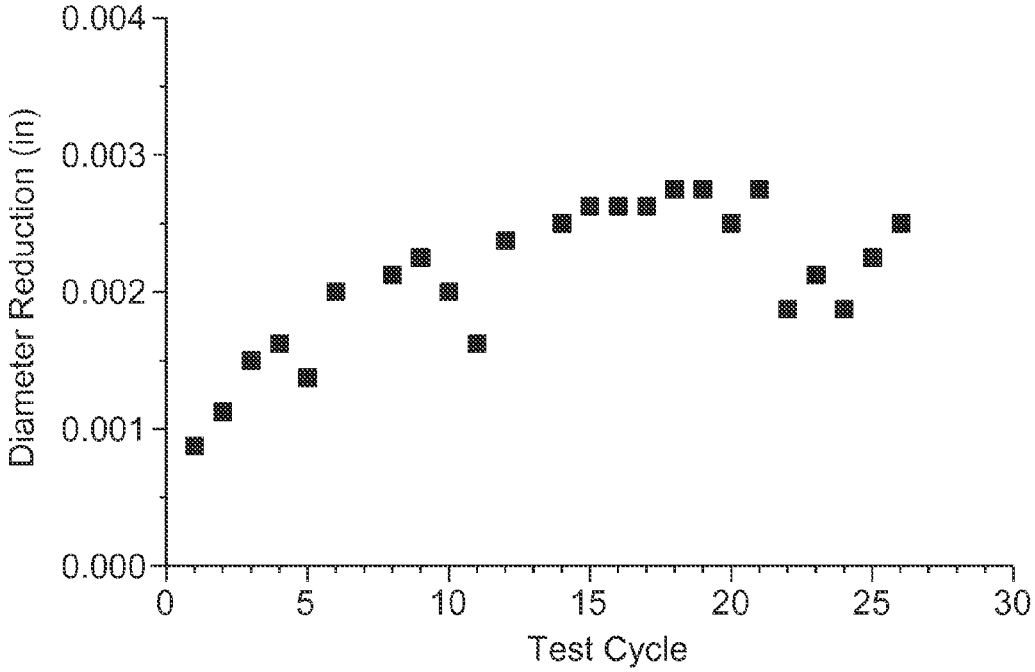
FIG. 6 is a graph of test bar diameter reduction on tungsten carbide using an Example 4 nonwoven abrasive wheel.
Figure 7:
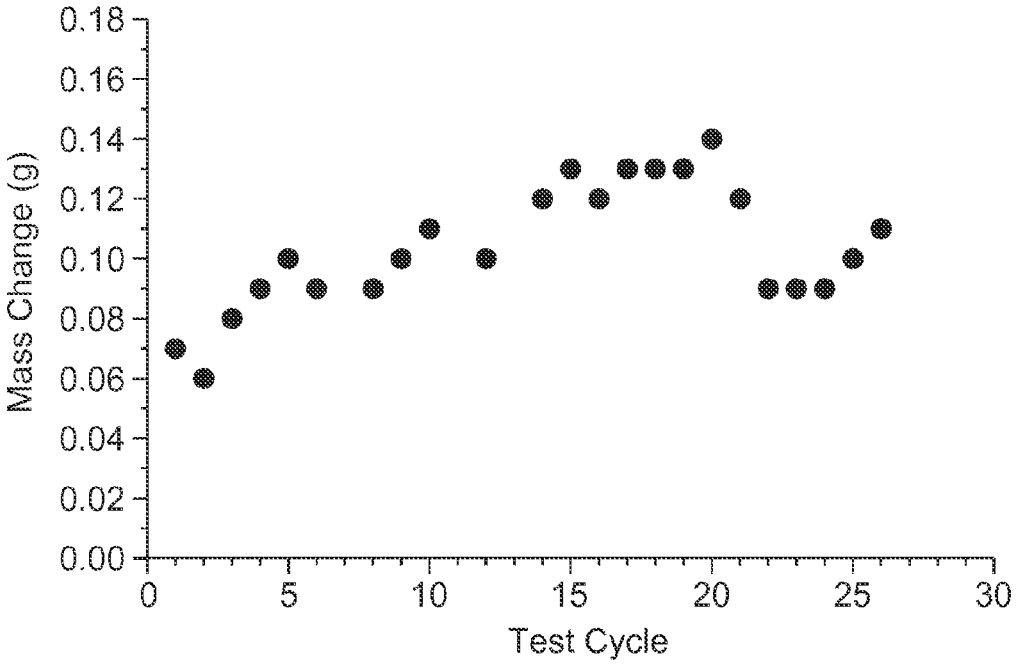
FIG. 7 is a graph of test bar stock removal on tungsten carbide using an Example 4 nonwoven abrasive wheel.

Unitized abrasive wheels can be provided, for example, by layering the impregnated nonwoven fiber web (e.g., as a layered continuous web or as a stack of sheets) compressing the nonwoven fiber layers, curing the curable composition (e.g., using heat), and die cutting the resultant abrasive article to provide a unitized abrasive wheel having a central hole. A unitized abrasive wheel 300 is shown in FIG. 3 having a plurality of nonwoven abrasive layers 310, which have been compressed and cured. After curing the abrasive layers, the resulting slab can be die cut to form the abrasive wheel having a central hole 320.

When compressing the layers of impregnated nonwoven fiber web in making an abrasive wheel, the one or more layers are typically compressed to form a slab having a density that is from 1 to 10 times that of the density of the layers in their non-compressed state. The slab is then typically subjected to heat molding (e.g., for from 2 to 20 hours) at elevated temperature (e.g., at 135° C.), typically depending on the urethane prepolymer and bun size.

To provide the desired reflective polishing or hard material finishing attributes the nonwoven abrasive wheels have a Flexural Modulus value from 4.0 to 128.0 0 lb/inch of thickness per inch of displacement, or from 10.0 to 128.0 0 lb/inch of thickness per inch of displacement, or from 25.0 to 128.0 0 lb/inch of thickness per inch of displacement, or between 45.0 to 128.0 0 lb/inch of thickness per inch of displacement, or from 65.0 to 128.0 lb/inch of thickness per inch of displacement, or from 100.0 to about 125 0 lb/inch of thickness per inch of displacement. As discussed more fully in the Examples, abrasive wheels less than 4.0 lb/inch of thickness per inch of displacement were too flexible and did not produce a reflective finish and abrasive wheels greater than 130.0 lb/inch of thickness per inch of displacement were too stiff and surprisingly did not produce a reflective finish.

To achieve the desired Flexural Modulus, the nonwoven abrasive wheel can comprise more than one nonwoven abrasive layer in order to sufficiently compress the nonwoven layers to the desired stiffness. In various embodiments of the invention, the nonwoven abrasive wheel can comprise between 2 to 10 nonwoven abrasive layers, or between 3 to 8 nonwoven abrasive layers.

EXAMPLES

Objects and advantages of this invention are further illustrated by the following non-limiting examples; however, the particular materials and amounts thereof recited in these examples, as well as other conditions and details, should not be construed to unduly limit this invention. Unless otherwise noted, all parts, percentages, ratios, etc. in the Examples and the rest of the specification are by weight.

Flexural Modulus Test

Test specimens were prepared by cutting a solid (no center hole) 4 inch×¼" nominal thickness (101.6 mm×6.35 mm) discs from the example article. Measurements of load and deflection were measured using an Instron model 4411 tensile test machine (obtained from Instron, Norwood, Mass.) fitted with a 500 N load cell. The test specimens were supported on the base of the tensile test machine using a 3-inch (76.2 mm) diameter schedule 40 black pipe. The test specimen support surface was cut at a 90 degree angle to the longitudinal axis of the pipe and the pipe has a sufficient length such that the center of the test specimen did not contact the base of the tensile test machine during testing. The center attachment post (0.79 inches (20.1 mm) in diameter) of the load cell mounted on the crosshead was used as the contact point positioned to encounter the diametric center of the test specimen. The crosshead of the tensile tester was lowered to an initial position such that it just contacted the surface of the test disc. This position of the crosshead was defined as zero deflection. The crosshead was then lowered at 0.1 inches per minute (2.54 mm per minute) to a total deflection of 0.1 inch (2.54 mm). Force measurements were recorded at least every 0.02 inches (0.51 mm) of deflection. The crosshead was raised and the test specimen was removed from the fixture. Any residual deformation of the test specimen was removed by pressing it against a planar surface. The test was repeated with the opposite side of the disc presented to the contact point.

The flexural modulus is calculated by first dividing the average of the front and backside measured load cell forces by the measured thickness of the test specimen to normalize the force data for differences in the abrasive wheel thickness. Next the normalized average force on the y-axis is plotted versus the displacement data on the x-axis. A statistical curve fitting program such as Microsoft EXCEL is used to find the slope of the load versus displacement curve. The slope of the fitted line is the Flexural Modulus in lb/inch of thickness per inch of displacement of the test specimen.

Finish Test A

A four inch (102 mm) diameter abrasive wheel to be tested was mounted on a pneumatic right angle grinder such as, #20236, obtained from 3M, St. Paul, Minn., via either a ⅝ inch (15.9 mm) or 1.25 inch (32 mm) arbor hole by using the appropriate adapter. The grinder supply air pressure was reduced to approximately 80 psi to obtain a 6000 RPM shaft speed under no load. The abrasive wheel was dressed by translating the face of the wheel against a 10 inch 36 grit aluminum oxide bonded wheel (Delta Cat. No. 23-983), mounted on a Delta 10 inch Bench Grinder Model 23-980, from Delta International Machinery Corp., Pittsburgh, Pa. A ½ inch diameter carbide mill tool blank was mounted into a bench top lathe such as Central Machinery brand Variable Speed Mini Lathe SKU #183 available from Harbor Freight Tools, Inc., Camarillo, Calif. The lathe speed was adjusted to obtain approximately 350 rpm spindle rotation under no load. The lathe rotation was toward the operator, while the grinder was presented for rotation away from the operator such that the lathe and grinder are rotating in same direction. The abrasive wheel periphery was manually urged against the carbide tool mounted in the lathe with a force of approximately 10 to 15 pounds. The contact area of the blank was kept wet with a water spray from a spray bottle. The abrasive wheel was urged against the carbide blank for 1 minute with slight side to side oscillation of approximately ⅜ inch. The carbide blank was then wiped dry with a paper towel and the surface finish was measured using a contact profilometer such as a Mahr Perthometer M2 from Mahr Federal Inc, Providence, R.I. Three readings are taken recording Ra and Rz in microinches. The results are reported as individual averages of the readings for Ra and Rz. The cut performance of the samples was measured using a digital vernier caliper such as a Brown & Sharpe DIGIT-CAL MK IV Model 599-571-4 from Hexagon Metrology, Inc., North Kingstown, R.I. Stock removal was measured by recording the diameter change on the cylindrical work piece in the abraded area. Four measurements were made around the OD of the blank both before and after testing. The stock removal results are reported as the average of the four measurements.

Finish Test B

A four inch (102 mm) diameter and 0.25 inch (6.35 mm) thick abrasive wheel was mounted on a bench grinder operating at 3500 rpm such as a Delta Model 23-880 8 inch bench grinder via either a ⅝ inch (15.9 mm) or 1.25 inch (32 mm) arbor hole by using the appropriate adapter. The abrasive wheel was dressed while rotating by translating an 8 inch or 10 inch Delta 36 grit aluminum oxide bonded wheel (Delta Cat. No. 23-883 or 23-983) against the face of the wheel. A 0.5 inch (12.7 mm) diameter carbide cutting blank was manually held and urged against the rotating wheel. A stream of water from a spray bottle was applied to the abrasive wheel-work piece interface for the duration of the contact. The work piece was oscillated side to side on the wheel for a distance of approximately 0.5 inch (12.7 mm) for approximately one minute. At the completion of the test, the blank was wiped dry with a paper towel and the surface finish was measured using a contact profilometer such as a Mahr Perthometer M2 from Mahr Federal Inc, Providence, R.I. Three readings are taken recording Ra and Rz in microinches. The results are reported as individual averages of the readings taken for Ra and Rz.

Finish Test C

A four inch (102 mm) diameter abrasive wheel was mounted on a servomotor shaft via a 1.25 inch (32 mm) arbor hole using a 1 inch (25.4 mm) adaptor. The servomotor speed was adjustable from 0 to 4135 RPM. The abrasive wheel was dressed by translating the face of the wheel against a 220 grit aluminum oxide dressing stick (220 AM-K, Boride Abraisves, Traverse City Mich.) held rigidly on a table surfaces. The servomotor speed was adjusted via a potentiometer for a no load speed of approximately 1500 RPM for dressing. The abrasive wheel periphery was automatically urged against the dressing stick with a force of 5 pounds for 1 minute with slight side to side oscillation of ⅛ inch. A ½ inch diameter tungsten carbide rod (p/n 8788A254, McMaster-Carr, Elmhurst Ill.) was mounted into a bench top lathe as described in Finish Test A. The lathe speed was adjusted to obtain approximately 350 RPM spindle rotation under no load. The servomotor speed was adjusted via a potentiometer for a no load speed of approximately 4135 RPM. The abrasive wheel was urged against the ½ inch diameter rod with a force of 5 pounds for 1 minute interval cycles, with slight side to side oscillation of ⅛ inch. The ½ inch rod was then wiped dry with a paper towel and the surface finish was measured using a contact profilometer as described in FINISH TEST A. Five readings are taken recording Ra and Rz surface finishes. The interval cut was measured by recording rod diameter change, using a digital vernier caliper as described in FINISH TEST A, taken in the center of the abraded area. Four measurements were made around the outer diameter of the work piece before and after each test interval. The mass of tungsten carbide stock removed was recorded after each cycle.

The following abbreviations listed in Table 1 are used throughout the Examples.

TABLE 1

ABBREVIATION INDEX

| Designation | Description |
|---|---|
| Fiber | nylon 6,6, staple fiber, 15 denier × 1.5" (17 dtex × 38 mm), from Invista S.A.R.L., Wichita, Kansas |
| water | tap water |
| T403 | curative premix of 25% JEFFAMINE T-403 in water, T-403 from Huntsman Petrochemical Corporation, The Woodlands, Texas |
| ER | Epoxy resin, EpiRez 3510-W-60 from Hexion Specialty Chemicals Inc., Houston, Texas |
| AF | silicon antifoam, "Antifoam 1520" from Dow Corning, Midland, Michigan |
| Pigment | carbon black, obtained as "C-Series Black 7 LCD4115" from Sun Chemical Corporation, Cincinnati, Ohio |
| LiSt | lithium stearate lubricant, 33% in T403; lithium stearate obtained as "Lithiumsoap I" from Baerlocher USA, Cincinnati, OH |
| EZ3 | acrylic viscosity modifier, 5% CARBOPOL EZ-3 in water from Lubrizol Corporation, Wickliffe, Ohio |
| BL46 | polyurethane prepolymer, obtained as ADIPRENE BL 46 from Chemtura Corporation, Middlebury, Connecticut |

TABLE 1-continued

| ABBREVIATION INDEX | |
|---|---|
| Designation | Description |
| BL16 | polyurethane prepolymer, obtained as ADIPRENE BL 16 from Chemtura Corporation, Middlebury, Connecticut |
| BL31 | polyurethane prepolymer, obtained as ADIPRENE BL 31 from Chemtura Corporation, Middlebury, Connecticut |
| PMA | propylene glycol monomethyl ether acetate, from Ashland Chemical Co., Columbus, Ohio |
| DEN | epoxy novolac resin, from Dow Chemical Company, Midland, Michigan as D.E.N. 438 Epoxy Novolac |
| XJ | surfactant, from Dow Chemical Company, Midland, Michigan as TERGITOL XJ |
| MP22 | micronized synthetic paraffin, from Micro-Powders, Inc., Tarrytown, New York as MP22 |
| 15S40 | surfactant, from Dow Chemical Company, Midland, Michigan as TERGITOL 15-S-40 (70%) |
| KAY A-A | amine curing agent, from Nippon Kayaku Company, Ltd., Tokyo, Japan as KAYAHARD A-A |
| K450 | amine curing agent, from Royce International, East Rutherford, New Jersey, as LAPOX K-450 |
| K450 PMX | 42.3% LAPOX K-450 in propylene glycol monomethyl ether acetate, LAPOX from Royce International, East Rutherford, New Jersey. |
| MDA PMX | 33% 4,4'-Methylene Dianiline (MDA) in propylene glycol monomethyl ether acetate, MDA from Aceto Corp., Lake Success, NY |
| AP10 | 10 micrometer diamond abrasive particles, from PINNACLE INDUSTRIES INC., WALNUT CREEK, CA, as 8-12 MPP Diamond Micron Powder |
| AP10A | 10 micrometer aluminum oxide particles from Micro Abrasives Corporation, westfiled, MA, as Microgrit WCA 9-11 microns |
| AP325 | 325/400 diamond abrasive particles, from PINNACLE INDUSTRIES INC., WALNUT CREEK, CA, as CMDP/CRDH Diamond Powder, 50/50 Mix, 325/400 Mesh, D46 (45 micron) |
| AP30 | 30 micrometer diamond abrasive particles, from PINNACLE INDUSTRIES INC., WALNUT CREEK, CA, as 22-36 MPP Diamond Micron Powder |
| AP200 | 200/230 diamond abrasive particles, from PINNACLE INDUSTRIES INC., WALNUT CREEK, CA, as CMDP/CRDH Diamond Powder, 50/50 Mix, 200/230 Mesh, D76 (75 micron) |
| AP320 | P320 aluminum oxide abrasive particles, from ART ABRASIVES LIMITED, TSIMSHATSUI, KOWLOON, HONG KONG as ARTIRUNDUM ACB P320 |
| AP120 | 120/140 cBN abrasive particles from WorldWide Superabrasives, Ft. Lauderdale, FL |
| CM | calcium silicate, from Nyco Minerals, Inc., Willsboro, New York as WOLLASTOCOAT 10012 |
| MS | hydrous magnesium silicate, from Luzenac America Inc., Three Forks, MT as MISTRON 353 |
| LiSt PMX | 44.1% lithium stearate in propylene glycol monomethyl ether acetate, lithium stearate from Baerlocher USA, Cincinnati, OH |
| PHEN | Solution of Phenoxy Resin in 1-methoxy-2-acetopropane (PM Acetate), from InChem Corp, Rock Hill, SC |
| AR | SILICONES AND SILOXANES, DIMETHYL-, REACTION PRODUCTS WITH SILICA, from Evonik Degussa Corporation, Parsippany, NJ, as Aerosil R202 VV60 |

Mixing Procedure A

The components in Table 2 were added in the order listed the table with mixing between each addition. The mixing was achieved using a high shear, high speed air mixer. Resin batch sizes were approximately 0.15-2.5 kg.

Mixing Procedure B

The components were warmed to 120 degrees F. A premix of the DEN, PMA, and XJ, was made as Premix 1 (hereafter referred to as PMX1). Components of PMX1 were preheated prior to mixing in an oven, such as a Despatch V series from Dispatch Industries, Inc., Minneapolis, Minn. The PMA was warmed to 70-105 degrees F., the DEN to 175-210 degrees F., and the XJ to 120-145 degrees F. After addition of the components, PMX1 was mixed until homogeneous. A premix of water, 15S40, and EZ3 was made as Premix 2 (hereafter referred to as PMX2). The components of PMX2 were preheated in an oven prior to mixing as with the PMX1 components. The water and 15S40 were warmed to 125-145 degrees F., and the EZ3 to 70-105 degrees F. A premix of the KAY A-A and K450 was made as Premix 3 (hereafter referred to as PMX3). BL46 was warmed to 120 degrees F. in an oven as with the PMX1 components. BL46 was added to a container and mixed vigorously while adding PMX1. Mixing was continued until the mix was uniform. Once the mix obtains uniformity, MP22 (warmed to 70-105 degrees F. in an oven) was added while mixing. Once the MP22 was thoroughly mixed in, PMX2 was added slowly while mixing. After PMX2 was completely added and the mix was uniform, CM and AP was added while continuing mixing. After CM and AP were incorporated, PMX3 (warmed to 70-105 degrees F. in an oven) was added while mixing. Mixing was continued for approximately one minute following the addition of PMX3. The mixing was achieved using a small Myers mixer. Resin batch sizes were approximately 0.2-3 kg.

TABLE 2

ABRASIVE SLURRY FORMULATION

| | Abrasive Slurry Formulation (%) | | | | | | | | | | |
|---|---|---|---|---|---|---|---|---|---|---|---|
| Component | A | B | C | D | E | F | G | H | I | J | K |
| KAY A-A | 2.3 | | | | | 2.45 | 2.41 | | | | |
| K450 | | 4.2 | 4.1 | 4.1 | 4.1 | 2.45 | 2.41 | | 4.5 | 3.2 | |
| K450 PMX | | | | | | | | 9.8 | | | |
| MDA PMX | | | | | | | | | | | 7.3 |
| PMA | 7.1 | 8.6 | 8.4 | 8.4 | 8.4 | 1.9 | 4.0 | 3.0 | 6.7 | 8.6 | 4.5 |
| LiSt PMX | 6.9 | 6.7 | 6.6 | 6.6 | 6.6 | | | 6.5 | 7.1 | 6.8 | 6.6 |
| PHEN | 8.9 | 9.6 | 9.3 | 9.3 | 9.3 | | | 9.5 | 8.9 | 9.5 | 9.5 |
| DEN | | | | | | 1.1 | 3.33 | | | | |
| BL46 | | | | | | 23 | 19.11 | | | | |
| BL16 | 18.4 | | | | | | | | | 20.9 | 21.1 |
| BL31 | | 20.8 | 20.8 | 20.8 | 20.8 | | | 20.8 | 17.9 | | |
| 15S40 | | | | | | 0.7 | 0.67 | | | | |
| XJ | | | | | | 0.5 | 0.67 | | | | |
| MP22 | | | | | | 1.5 | 1.44 | | | | |
| CM | 7.3 | 6.6 | 6.4 | 6.4 | 6.4 | 3.4 | 3.22 | 6.5 | 7.1 | 6.8 | |
| MS | | | | | | | | | | | 6.6 |
| water | | | | | | 14.8 | 17.77 | | | | |
| EZ3 | | | | | | | 0.19 | | | | |
| AR | | 0.3 | 0.3 | 0.3 | 0.3 | | | 0.3 | | | 0.3 |
| AP10 | 49.1 | 43.3 | | | | 47.6 | 44.79 | 43.5 | 47.7 | 44.1 | |
| AP325 | | | 44 | 28.6 | 15.4 | | | | | | 44.0 |
| AP320 | | | | 15.4 | 28.6 | | | | | | |

Slurry-Coated Web Making Procedure

A low density, non-woven, fibrous web weighing 125.29 g/m$^2$ was formed from 15 denier nylon 6,6 fibers on a web-forming machine. The resulting low density web was roll coated with a binder coating to provide a dry add-on weight of 50.37 g/m$^2$ using a coating solution of 47.51% water, 26.36% T403, 17.61% ER, 0.50% AF, 1.00% Pigment, 2.79% LiSt, and 4.23% EZ3. The binder coating was cured to a tack-free state by passing the roll coated web through a convection oven maintained at 171 degrees C. for a dwell time of 3 minutes. The resulting coated nonwoven web (hereafter referred to as prebond) was around 235 mils thick and weighed about 175.67 g/m$^2$.

The abrasive slurry prepared by either mixing procedure A or B, was coated with the abrasive slurry via a roll coater onto the prebond to achieve a total target wet weight of 1988 g/m$^2$. The slurry-coated web was dried to about 8% solvent retention.

General Forming Procedure 1

Layers of the partially-dried slurry-coated web were laminated by being placed between two metal plates and compressing to a thickness of 0.25 inch (6.35 mm). Then the whole assembly was placed in an oven maintained at 245 degrees F. (118 C) for four hours. At the end of the four hours, the metal plates were removed and the cure was continued for 14 hours at 245 degrees F. (118 C). After allowing the cured slabs to cool, abrasive wheels were die cut from the nominal 0.25 inch (6.35 mm) slab.

General Forming Procedure 2

Layers of the partially-dried slurry-coated web were stacked and placed in a platen press heated to 250 degrees F. (121 degrees C.), compressed to 0.25 inch (6.35 mm), and held at a pressure of 50 psi (345 kPa) for 30 minutes. The resulting slab was removed from the platen press and post-cured at 275 degrees F. (135 degrees C.) for 2.25 hours. After allowing the cured slabs to cool to room temperature, abrasive wheels were die cut from the nominal 0.25 inch (6.35 mm) thick slabs.

Sample Fabrication

One to eight partially dried layers, with the same type of abrasive slurry, were assembled according to Table 3 below, using one of the General Forming Procedures described above.

TABLE 3

SAMPLE FABRICATION

| Example | Abrasive Slurry mix | Layer count | Forming procedure | Mixing Procedure |
|---|---|---|---|---|
| 1 | A | 1 | 2 | A |
| 2 | B | 5 | 2 | A |
| 3 | C | 4 | 2 | A |
| 4 | F | 5 | 1 | B |
| 5 | G | 6 | 1 | B |
| 6 | G | 8 | 1 | B |
| 7 | I | 1 | 2 | A |
| 8 | J | 2 | 2 | A |
| 9 | J | 7 | 2 | A |
| 10 | J | 2 | 2 | A |
| 11 | H | 5 | 2 | A |
| 12 | B[1] | 5 | 2 | A |
| Comp. A | D | 4 | 2 | A |
| Comp. B | E | 4 | 2 | A |
| Comp. C | F[2] | 5 | 1 | B |
| Comp. D | B[3] | 5 | 2 | A |
| 13 | K[4] | 5 | 2[4] | A |
| 14 | K[5] | 5 | 2[4] | A |
| Comp. E | K[6] | 5 | 2[4] | A |

[1]Example 12 was constructed similar to Example 2 by replacing AP10 in the Abrasive Slurry Formulation with AP200 in the exact amount.
[2]Comparative Example C was constructed similar to Example 4 by replacing AP10 in the Abrasive Slurry Mix with AP10A in exact amount.
[3]Comparative Example D was constructed similar to Example 2 by replacing AP10 in the Abrasive Slurry Mix with AP320 in exact amount. Testing was conducted the same as Example 12.
[4]Example 13, Example 14, and Comparative Example E, were formed using General Forming Procedure 2 with a thickness of ⅜ inches thickness instead of ¼ inches.
[5]Example 14 was constructed similar to Example 13 by replacing the AP325 in the Abrasive Slurry Mix with AP120 in exact amount.
[6]Comparative Example E was constructed similar to Example 13 by replacing the AP325 in the Abrasive Slurry Mix with AP320 in exact amount.

Carbide Tool Results

Abrasive wheels having an outer diameter of 4 inches were evaluated for visual aesthetic quality, finish, and cut. Visual aesthetic quality was performed by observing the degree of reflectivity imparted to the finish on the workpiece and rated according to the scale given in Table 4.

TABLE 4

REFLECTIVITY RATING

| Rating | Observation |
|---|---|
| 1 | No observable effect on initial finish |
| 2 | Little effect on initial finish |
| 5 | Some refinement of initial finish by measured roughness reduction |
| 8 | Observable reflections in finished surface |
| 10 | Specular (mirror-like) finish |

The finish, cut, and Flexural Modulus results are reported in Table 5. Results are presented for Examples 1-10 and 12 along with results for Comparative Examples A-D.

TABLE 5

RESULTS

| Example | Flexural Modulus | Finish (Ra, Rz) | Finish Test Procedure | Cut | Visual aesthetic quality | Notes |
|---|---|---|---|---|---|---|
| 1 | 1.058 | 3.7, 19.8 | A | 0.00025 | 5 | Integrity failure, wheel chunked |
| 2 | 78.901 | 2.9, 18.3 | A | 0 | 8 | Shiny, slight wave |
| 3 | 55.704 | 9.0, 52 | A | 0.0025 | 5 | Satin finish |
| 4 | 119.95 | 2.1, 11.5 | A | 0.0009 | 10 | Superior aesthetic quality |
| 5 | 130.24[1] | 3.6, 23.7 | A | 0.0011 | 5 | Difficult to dress and true |
| 6 | 136.71[1] | 5.2, 32.3 | A | 0.001 | 5 | Difficult to dress and true |
| 7 | 1.768 | 4.4, 26.5 | A | 0.0005 | 5 | Integrity failure, wheel chunked |
| 8 | 5.7859 | 2.2, 12.3 | A | 0.0005 | 8 | Shape not very stable |
| 9 | 47.345 | 6.2, 42.3 | A | 0.0005 | 8 | Residual scratches visible |
| 10 | 18.24 | 2.6, 16.0 | A | 0 | 10 | Faint scratches visible |
| 12 | NA | 8.8, 48.3 | A | 0.001 | 2 | Coarse satin finish |
| Comp A | 70.966 | 3.5, 23.7 | A | 0 | 5 | Residual scratch marks |
| Comp B | 67.354 | 5.3, 50.0 | A | 0 | 2 | Blotchy finish, little change |
| Comp. C | 97.936 | 9.0, 77.0 | A | 0 | 2 | Very little change |
| Comp. D | NA | 10.9, 98.7 | A | 0 | 1 | No visible change in finish |

[1]Deflection interval was set to 0.1 inches.

As seen in Table 5 when the Flexural Modulus was less than 2.0 lb/inch of thickness per inch of displacement, the abrasive wheel was unsuitable for use and failed by tearing apart. Thus, suitable nonwoven abrasive wheels have a Flexural Modulus greater than 2.0 lb/inch of thickness per inch of displacement. When the Flexural Modulus was greater than 130.0 lb/inch of thickness per inch of displacement, the abrasive wheel became too hard for the intended surface polishing. Surprisingly, the stiff nonwoven abrasive wheels failed to produce a reflective or specular surface finish on the carbide tool even though extremely stiff vitrified or metal-bonded abrasive wheels routinely do. Thus, suitable nonwoven abrasive wheels have a Flexural Modulus less than 130.0 lb/inch of thickness per inch of displacement. Example 4 having a Flexural Modulus near 120 lb/inch of thickness per inch of displacement, among other construction variables, produced the best surface finish removing fine scratches and producing a specular finish.

Hard Material Finishing Results

While the nonwoven abrasive wheel has primarily been discussed for its usefulness in imparting a mirror-like finish to carbide tools, it has also been found very useful for refining the surface finish of hard materials. In particular, Example 11 was used to impart a finish on the hard materials listed in Table 6. A modified Finish Test B procedure was used by replacing the carbide workpiece with a workpiece of the material listed in Table 6 and measuring the surface roughness before and after the testing.

TABLE 6

HARD MATERIAL FINISHING RESULTS

| Workpiece material | Initial Ra | Initial Rz | Final Ra | Final Rz |
|---|---|---|---|---|
| Carbide Tool Insert | 10.3 | 87 | 4.51 | 33 |
| Silicone Nitride Si3N4 | 11.0 | 80.0 | 2.8 | 28 |
| Sapphire | 9.7 | 90.3 | 3.5 | 31.3 |
| Spinel, MgAl2O4 | 8.9 | 98.0 | 4.6 | 48.7 |
| 95% Alumina, Al2O3 | 36.0 | 259.0 | 14.0 | 116.7 |
| 88.4% Alumina, Al2O3 | 17.6 | 168.3 | 5.8 | 57.7 |

As seen in Table 6, the nonwoven abrasive wheel of the present disclosure is also suitable for refining the surfaces of hard materials. Typically, these materials need to be refined using an abrasive slurry polishing technique to obtain the final smoothness values produced by the nonwoven abrasive wheel of the present disclosure. In particular, the sapphire workpiece was transformed from a translucent material to a transparent material.

Steel Material Finishing Results

TABLE 7

STEEL MATERIAL FINISHING RESULTS ACCORDING TO FINISH TEST A

| | Work Piece Material | | | | | |
|---|---|---|---|---|---|---|
| | Stainless Steel Rod (SS) | | 1018 Carbon Steel Rod (CS) | | D2 Hardened Steel (HS) | |
| Example | Finish (Ra, Rz) | Cut | Finish (Ra, Rz) | Cut | Finish (Ra, Rz) | Cut |
| 13 | 3.4, 25.0 | 0.00075 | 8.9, 67.0 | 0.002 | | |
| 14 | 17.6, 132.0 | 0.001125 | 12.6, 85.7 | 0.00225 | | |
| Comp F | 4.4, 33.7 | 0.000375 | 13.0, 81.0 | 0.0015 | | |

Example 13 produced a satin finish on both the SS and CS. Example 14 increased the surface roughness on both SS and CS. Comparative F produced a finish that was slightly less than shiny on the SS and increased the surface roughness on the CS though was shinier than the Example 14 finish on CS.

The nonwoven abrasive wheel of Example 4 was tested further under tightly controlled test conditions to show the finish and cut consistency over an extended series of test cycles. FIGS. 4-7 show surface roughness characteristics Ra, Rz, and the stock removal performance for the Example 4 nonwoven abrasive wheel using Finish Test C.

It is believed that when nonwoven abrasive wheels like Example 4 are used to polish metal cutting tool flutes and rake faces to a mirror finish, the polishing promotes the penetration and flow of cutting fluids and easier removal of metal chips, thereby reducing the tool-work piece interface temperature and improving the cutting efficiency of the tool. For example, it has been demonstrated that an unpolished or as-machined cutting tool produces 1000 drill bit parts before the carbide cutting tool requires resharpening. The same as-machined carbide cutting tool, after having the rake faces and flutes polished to a mirror finish by an Example 4 nonwoven abrasive wheel produces more than 3000 drill bit parts before needing to be resharpened.

Other modifications and variations to the present disclosure may be practiced by those of ordinary skill in the art, without departing from the spirit and scope of the present disclosure, which is more particularly set forth in the appended claims. It is understood that aspects of the various embodiments may be interchanged in whole or part or combined with other aspects of the various embodiments. All cited references, patents, or patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. A nonwoven abrasive wheel comprising: one or more layers of a nonwoven fiber web, a plurality of super abrasive particles having a Vickers hardness greater than 40 GPa, a polyurethane binder adhering the plurality of super abrasive particles to the nonwoven fibers and adhering the layers of the nonwoven fiber web to each other, and wherein the nonwoven abrasive wheel comprises a Flexural Modulus from 4.0 to 128.0 lb/inch of thickness per inch of displacement.

2. The nonwoven abrasive wheel of claim 1 comprising a unitized abrasive wheel.

3. The nonwoven abrasive wheel of claim 1 comprising 2 to 10 layers of the nonwoven web.

4. The nonwoven abrasive wheel of claim 1 wherein the super abrasive particles comprise diamonds having an average size from 1 to 45 micrometers.

5. The nonwoven abrasive wheel of claim 1 wherein the polyurethane binder comprises a durometer hardness from 35 to 80 Shore D.

6. The nonwoven abrasive wheel of claim 1 wherein the Flexural Modulus is from 100.0 to 125.0 lb/inch of thickness per inch of displacement.

7. A method of producing a specular finish on a carbide surface comprising contacting the carbide surface with the nonwoven abrasive wheel of claim 1.

* * * * *